United States Patent [19]

Guy, Jr.

[11] 4,027,493

[45] June 7, 1977

[54] METHOD AND APPARATUS FOR CONNECTING TWO OR MORE COMPONENTS OF AN OFFSHORE PLATFORM

[75] Inventor: Arthur L. Guy, Jr., Houston, Tex.

[73] Assignee: Exxon Production Research Company, Houston, Tex.

[22] Filed: Apr. 15, 1976

[21] Appl. No.: 677,345

[52] U.S. Cl. ..... 61/96; 61/110

[51] Int. Cl.[2] ..... E02D 21/00

[58] Field of Search ..... 61/46.5, 64, 96, 110; 114/77 R, 65 R, .5 D

[56] References Cited

UNITED STATES PATENTS

| | | | |
|---|---|---|---|
| 2,210,408 | 8/1940 | Henry | 61/46.5 |
| 2,496,532 | 2/1950 | Gross | 61/46.5 |
| 3,641,774 | 2/1972 | Hekkanen | 61/46.5 |

*Primary Examiner*—Jacob Shapiro
*Attorney, Agent, or Firm*—John S. Schneider

[57] ABSTRACT

Method and apparatus for joining two or more substructure components of an offshore platform in the water to form a unitary substructure component or jacket. An offshore platform to be located in deep water includes a jacket having at least two sections each composed of at least three legs. The legs are hollow and compartmented and provided with means to adjust the buoyancy of each leg. Each section is launched separately and floated in the horizontal position with sufficient buoyancy to maintain at least one leg at or above the water's surface. One of the sections is floated toward a selected shore site until its submerged leg or legs are grounded and the jacket section made negatively buoyant. Another jacket section is floated to the shore site and its legs are aligned with the legs of the already grounded section. The companion legs of each section are then joined to form a unitized jacket. The other jacket section may also be grounded and made negatively buoyant prior to joining the two sections. Support means, such as skids and/or jacks may be used to transform the sea floor at the shore site to a desired, proper grade or slope for joining the jacket sections. The utilized jacket is floated to the deep water location at which the offshore platform is to be installed and the sections are controllably ballasted to position the jacket upright. The jacket is then anchored to the sea floor and the deck of the platform is placed or stabbed onto the anchored jacket.

18 Claims, 21 Drawing Figures

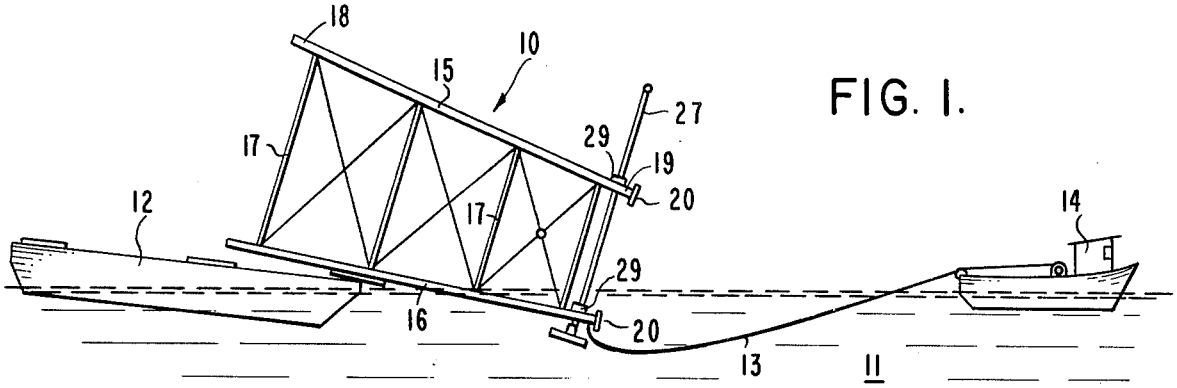
FIG. 1.
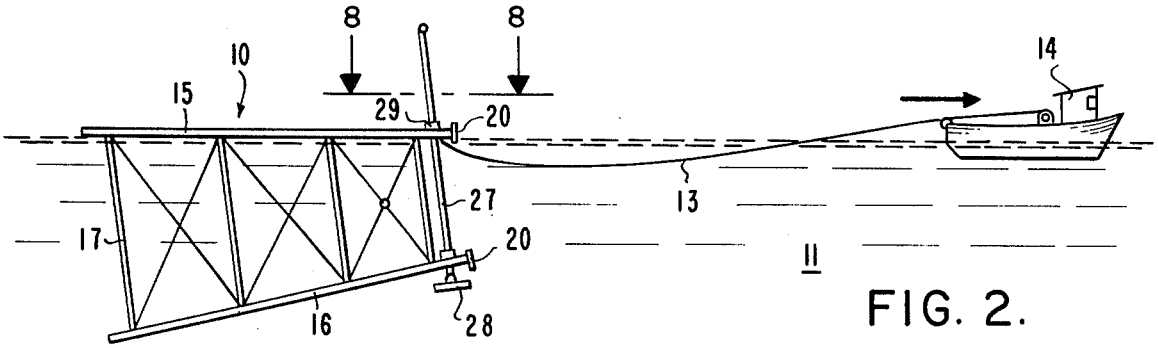
FIG. 2.
FIG. 3.
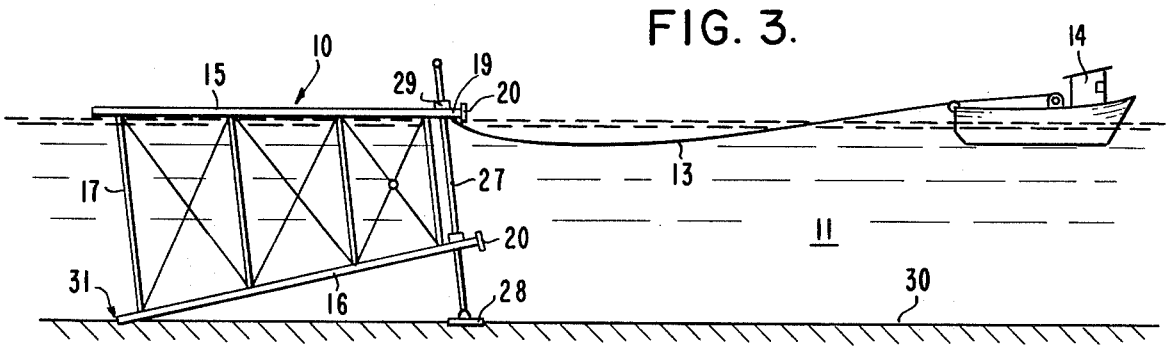
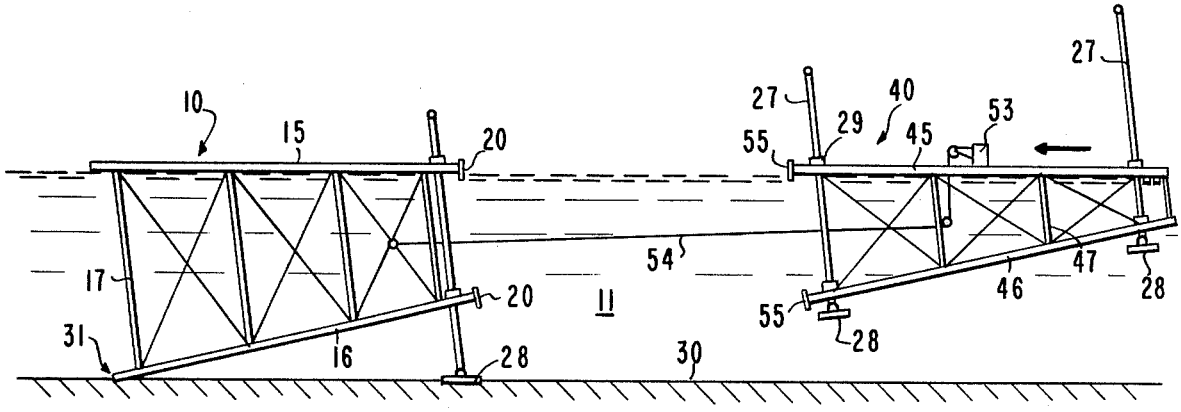
FIG. 4.

FIG. 12.
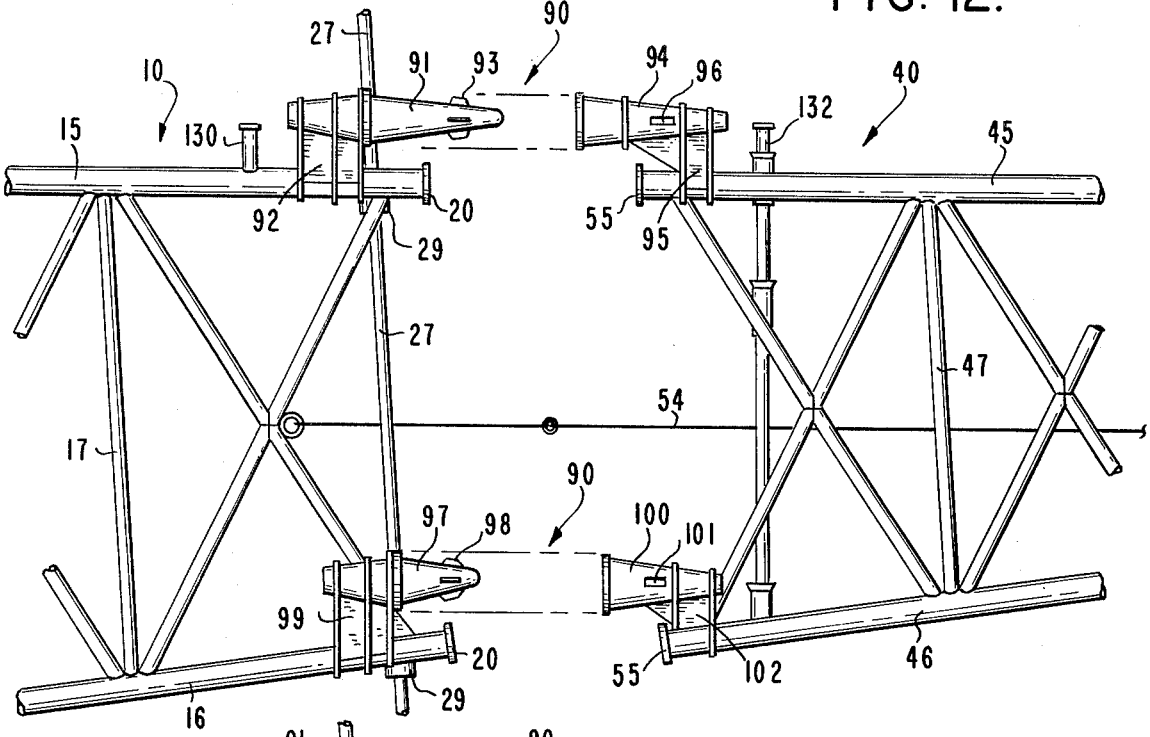
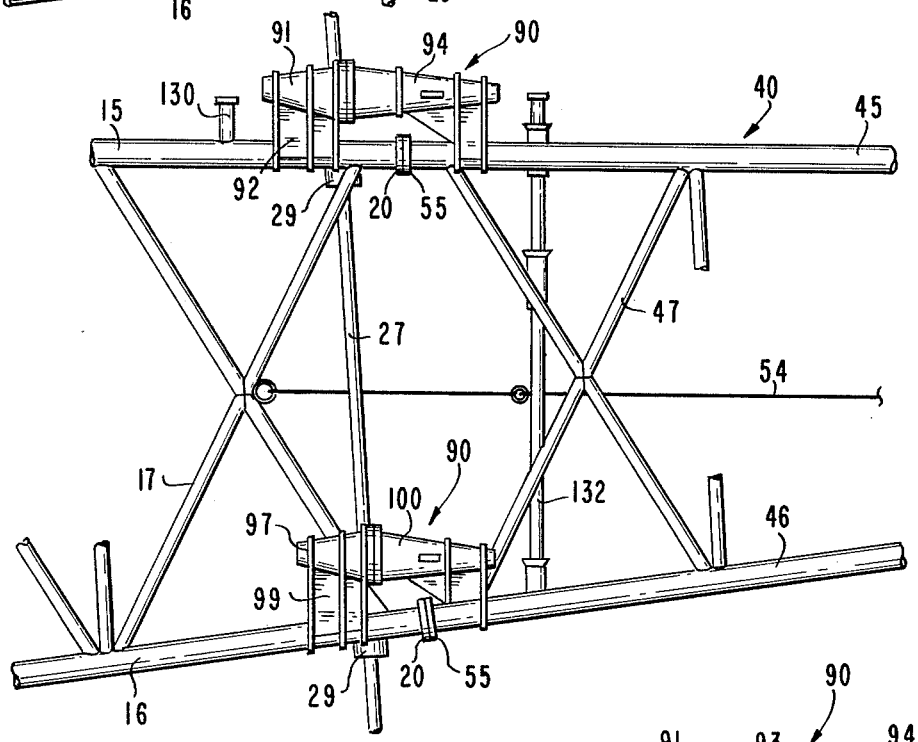
FIG. 13.
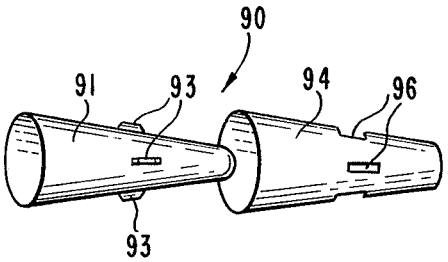
FIG. 14.

FIG. 15.
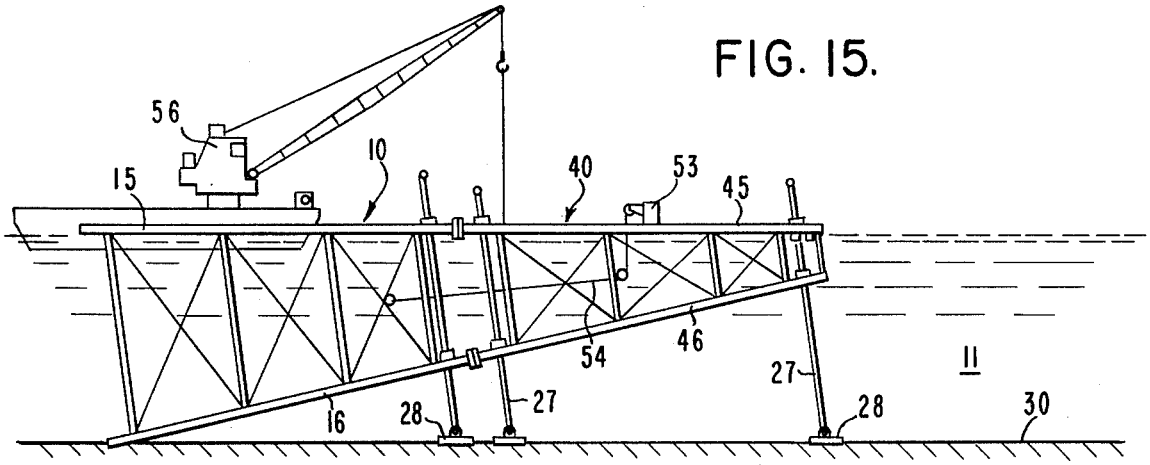
FIG. 16.
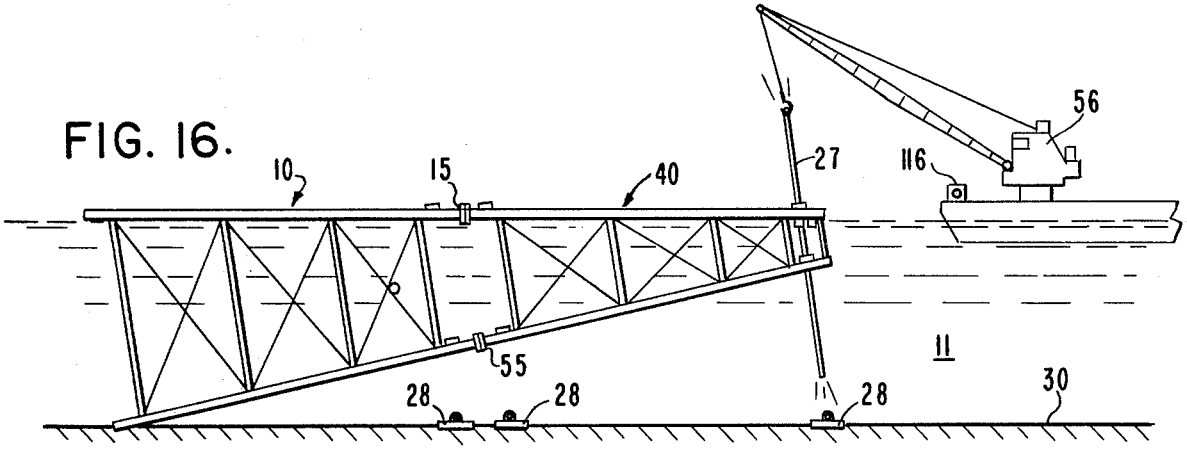
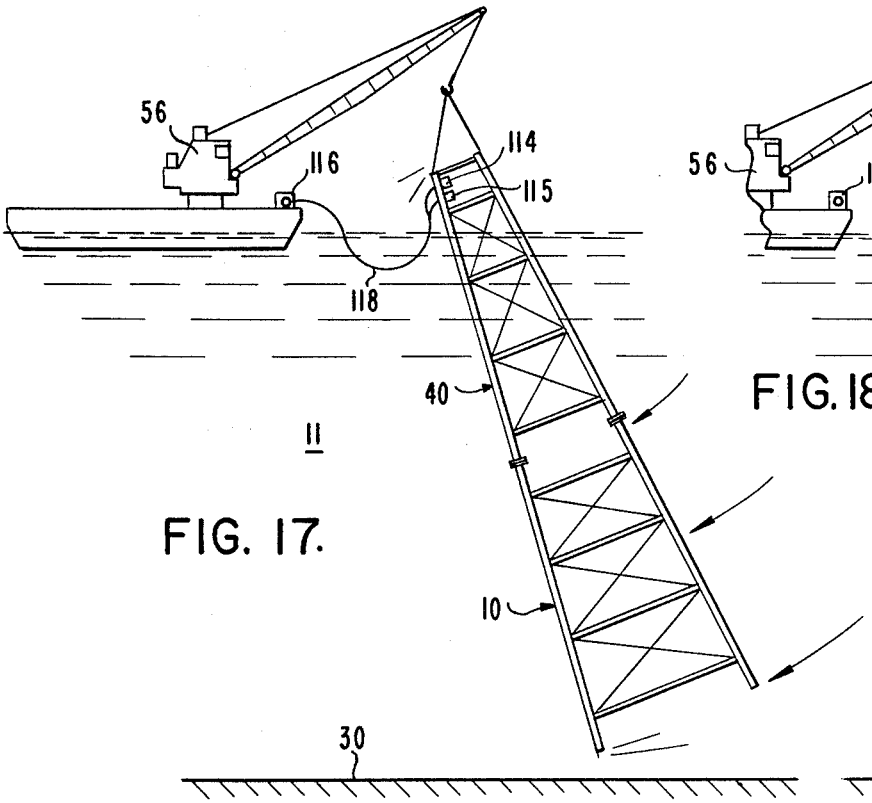
FIG. 17.
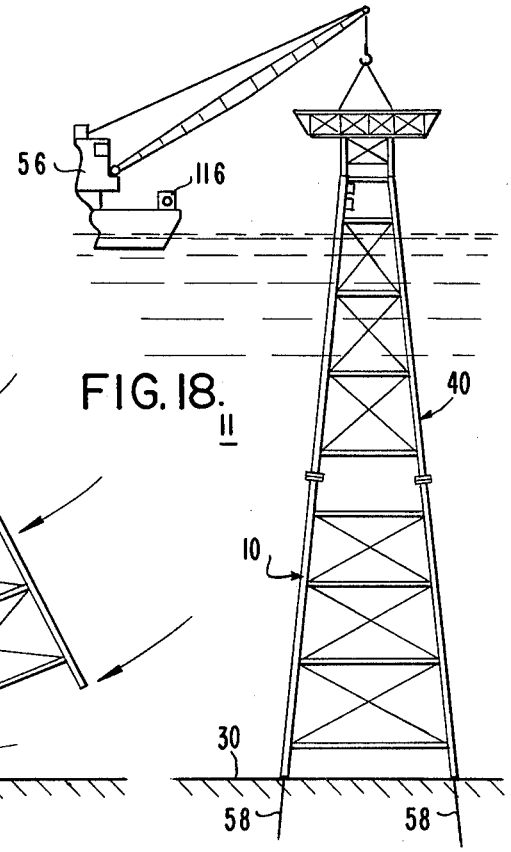
FIG. 18.

METHOD AND APPARATUS FOR CONNECTING TWO OR MORE COMPONENTS OF AN OFFSHORE PLATFORM

BACKGROUND OF THE INVENTION

1. Field of the Invention

The present invention concerns offshore platforms in which the supporting substructure or jacket is fabricated remote from the site of platform installation. More particularly, the invention concerns method and apparatus for connecting two sections of an offshore jacket for an offshore platform in water at a shore location remote from the deep water installation site at which the offshore platform is to be erected.

2. Description of the Prior Art

It is known in the art that offshore platforms may be installed in deep waters by floating the platform jacket in a horizontal position to the site for installation of the offshore platform in an assembled or an unassembled condition. At the installation site the legs of the jacket are controllably flooded to cause the jacket to assume an upright position on the sea floor.

In U.S. Pat. No. 3,859,806, entitled "Offshore Platform" filed Oct. 1, 1973 by Guy et al., a method for fabricating an offshore platform for use in deep water is disclosed in which sections of the platform support component or jacket are connected together while the sections are floating in a horizontal position in the water. The sections are guided into proper alignment and then joined. Access tubes from the surface of the water to the legs of the sections permit direct internal welding in securing the legs of the sections together. The sections are then floated to a selected erection site and the sections sunk at that site by controllably flooding the legs until the jacket is in an upright position. The jacket is then anchored to the sea floor by driving pilings through the jacket's hollow legs into the sea floor. Thereafter the deck of the platform is placed or stabbed on the anchored jacket.

The present invention involves erecting an offshore platform in deep water in the manner described in the aforementioned Guy et al patent; however, instead of connecting sections of the jacket while they are floating in the water at least one of the jacket sections is first grounded in a stationary position at a shore or beach site. This invention is applicable where no protected water is available or where ambient sea conditions are too rough to connect sections of the jacket together while they are floating.

SUMMARY OF THE INVENTION

The method of connecting two or more components of an offshore platform to form a single jacket unit comprises launching into water at least two sections of the offshore jacket separately. Each section contains three or more hollow legs, each provided with means for flooding and dewatering compartments in the legs to control buoyancy of the legs. The legs are floated in the water in a horizontal position with sufficient positive buoyancy to maintain at least one leg at or above the water's surface and the remaining leg or legs submerged. When in an upright or vertical installed position for the offshore platform each section is wider at its base than at its top and the jacket legs slant upwardly and inwardly from bottom to top. The sections are then floated to a selected shore or beach site. One of the sections is floated into shore until its submerged leg or legs are grounded in the shallower water. The section is grounded so that the surface legs extend horizontally adjacent the water's surface. The section sits on bottom and has a slightly negative buoyancy, i.e. is not floating and is not subject to movement by ambient sea conditions. Another section is then floated to the first grounded section, the companion legs of the sections are aligned and the other section moved or pulled toward the first grounded section and the companion legs of the sections properly guided into connecting position. The other section is first adjusted for proper alignment with the first section and may also be grounded and have slightly negative buoyancy. The companion legs of the sections of the jacket are then joined. Once connected the sections are again floated with one or more legs at or above the surface of the water and the remaining legs submerged. The single jacket unit is then floated to the platform erection site, the jacket legs are controllably flooded and the jacket is caused to assume an upright position resting on the sea floor. Pilings are driven through the hollow legs into the sea floor to anchor the unitized jacket. A working deck is then provided on the upper surface ends of the jacket legs.

If a suitable natural grade sea floor at the shore site for connecting the sections of the jacket of the sections together is not available to support the grounded legs properly then support means are employed to adjust the ground at the grounding site to the proper grade. Such supporting means for the jacket sections may suitably be skids and/or support columns. Each support column may be releasably connected at one end to a base member which rests on the sea floor and at the other end to the jacket sections.

BRIEF DESCRIPTION OF THE DRAWINGS

FIGS. 1 to 4 illustrate the preliminary steps for connecting the two components of an offshore platform to form a single unit in accordance with the method of the invention;

FIGS. 12 to 14 illustrate means for aligning the matching legs of the two sections as they are moved together for connection;

FIG. 15 shows the two sections connected;

FIG. 16 shows the supporting means being removed;

FIG. 17 illustrates the erecting operation of the joined sections;

FIG. 18 shows the work platform being connected to the top of the substructure.

DESCRIPTION OF THE PREFERRED EMBODIMENTS

Figure 5:
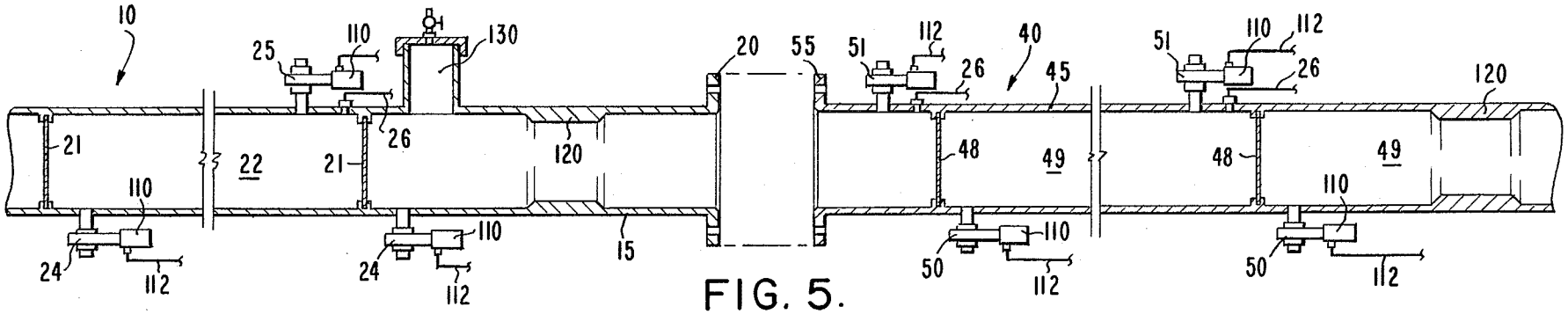
FIGS. 5 to 7 illustrate the compartmentation of the legs of the structure and access tubes for internal welding once the leg sections are connected.

In FIG. 1 there is shown a bottom section 10 of a platform substructure or jacket for an offshore platform being launched into water 11 from a transport barge 12. A towline 13 connects a work boat or tug 14 to section 10 as shown. Section 10 contains four legs (only two of which 15 and 16 are shown) and cross struts and bracing 17. When in the erected position, legs 15 and 16 slant inwardly in the upward direction with the wider end 18 of the section being the lower end and the narrow end 19 being the upper end of the jacket. Each of the upper ends of the legs are provided with flanges 20.

Figure 6:
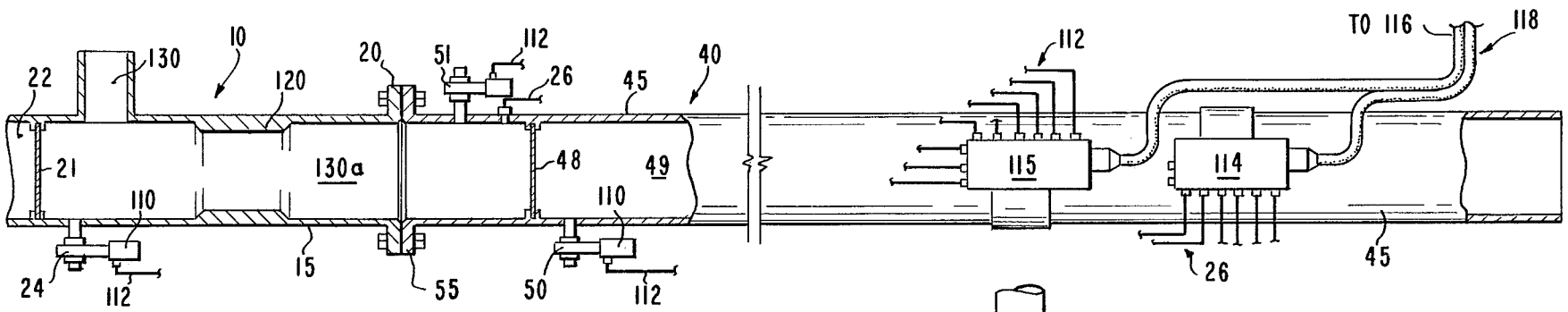
Figure 7:
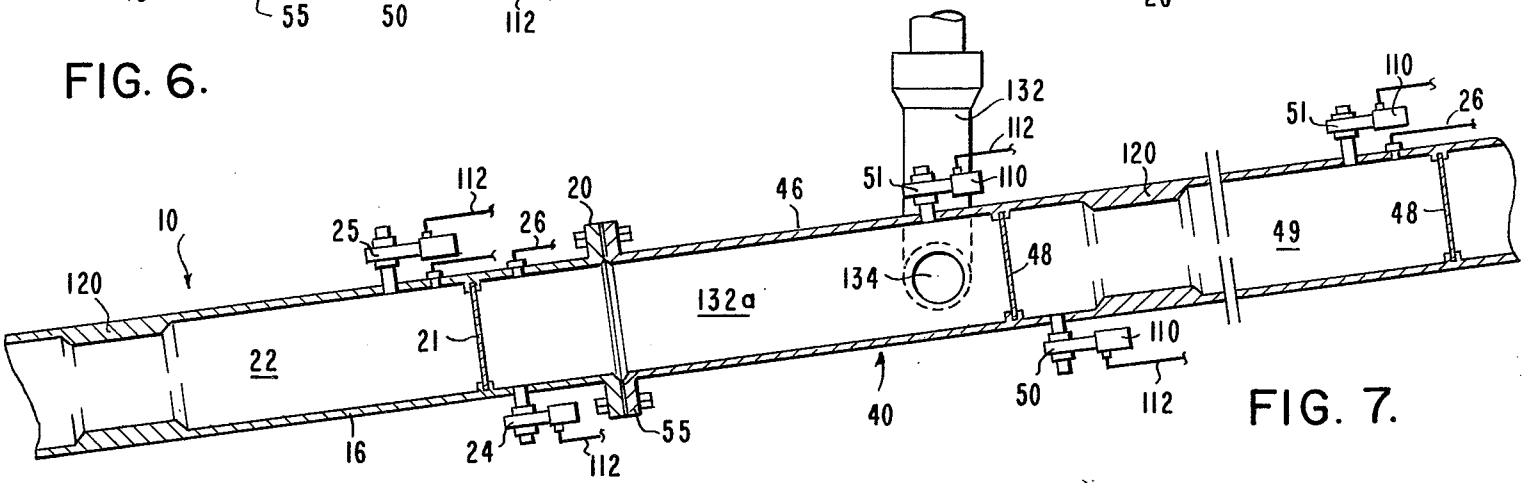

As shown in detail in FIGS. 5 through 7 each of the legs is hollow and provided with bulkheads 21 forming watertight and airtight compartments 22 therebetween. Each of the compartments 22 has connected thereinto a sea cock 24, a vent valve 25 and air injection conduit 26 for the purpose of flooding and dewatering the compartments to control and adjust the buoyancy of section 10.

Referring to FIGS. 1 to 4 adjustable support mechanisms (only one of which is seen in these Figures) include support columns 27, base members 28 and releasable clamps 29. These support mechanisms, described in more detail with respect to FIGS. 8 through 11, are arranged on the upper end 19 of section 10 adjacent flanges 20.

As shown in FIG. 2 section 10 is floated in a horizontal position with the legs 15 at the surface of the water and the legs 16 submerged by adjusting the buoyancy of section 10 either before or after launching. Section 10 is then towed by barge 14 toward shore until the lower ends of the submerged legs 16 ground as indicated at 31 in FIG. 3.

As the lower ends of the submerged legs are grounded, section 10 may be raised slightly out of the water (by a crane, by suitably placed hydraulic jacks and/or by adjusting the buoyancy of the section) and support columns 27, base members 28 and clamps 29 positioned such that section 10 is no longer floating and is supported at 31 and by support columns 27. In this position section 10 has a slightly negative buoyancy and cannot be moved about by ambient sea conditions. Legs 15 are positioned slightly above and parallel to the water surface to facilitate connection of an upper section 40 of the jacket to section 10.

Upper section 40 of the offshore platform jacket is also launched into the water 11 in the same manner that section 10 was so launched and is towed toward the beach or shore location near section 10 as illustrated in FIG. 4. Section 40 includes hollow legs 45 and 46 and cross bracing and struts 47. As shown in FIGS. 5 through 7 legs 45 and 46 also have bulkheads 48 forming water and airtight compartments 49 each of which has a sea cock 50, a vent valve 51 and an air injection line 52 connected thereto for the purpose of flooding and dewatering the compartments to control and adjust the buoyancy of section 40. Support mechanisms, the same as those provided on section 10 and designated with the same reference numerals i.e. support columns 27, base members 28 and clamps 29, are provided on section 40, preferably at each end thereof as shown. The lower end of each leg 45 and 46 is provided with a flange 55 adapted to be connected to its companion flange 20 on section 10. The buoyancy of section 40 may be adjusted to position legs 45 at the same level as legs 15 of section 10 and the companion legs aligned and/or section 40 may be raised out of the water by a crane or by hydraulic jacks so that legs 45 and 15 are at the same level and aligned and support columns 27 positioned to support section 40 on the sea floor. The sections are then joined. As illustrated a winch may be mounted on section 40 and connected to section 10 by a cable 54. Section 40 is drawn towards section 10 and guided into position in the same manner as disclosed in the aforementioned Guy et al patent and as shown in FIG. 5 and in more detail in FIGS. 12 through 14. The sections also may be drawn together by suitably placed hydraulic cylinders or any other suitable means.

The buoyancy of each section may be adjusted as desired at any time during joinder of the sections to ensure that the sections are properly positioned. At least section 10 and, preferably, both sections 10 and 40 should have a slightly negative buoyancy while being connected together. Once flanges 55 and 20 have engaged the legs are joined by remotely operated mechanical connectors and/or by bolts operated by divers. The connection is then welded from the interior of the hollow legs. A crane barge 56 may be used to handle the sections while the connecting operations are being conducted.

Referring now to FIG. 16 crane barge 56 may be used to release and remove support columns 27 from sections 10 and 40.

Before removing the unitized substructure or jacket from the shore location the legs may be made more buoyant to aid in disengaging the grounded ends 18 from the sea floor. With legs 16 and 45 at or slightly above the water surface the substructure unit is towed to the installation or erection site and, as shown in FIG. 17, a crane barge 56 is used to turn the jacket upright by controlling buoyancy of the legs and adjusting the buoyancy from, for example, a control box 57. As shown in FIG. 18 once the jacket has been installed in a vertical position anchor piling 58 is driven through the legs of the structure and into the sea floor 30. A work platform is then connected to the top of the substructure.

Figure 8:
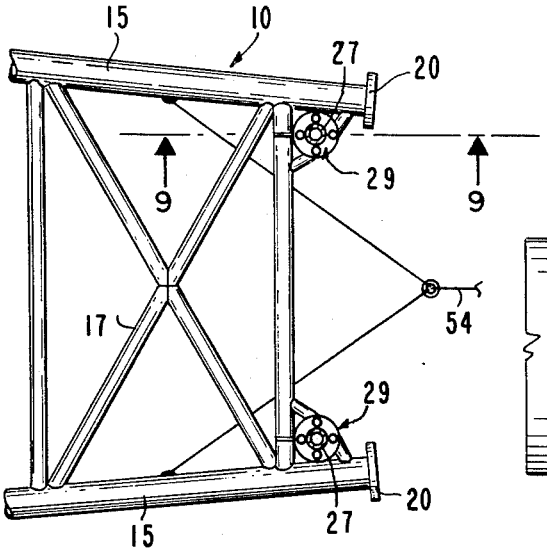
FIGS. 8 to 11 illustrate support means for grounding the sections to the sea floor during connecting operations.
Figure 9:
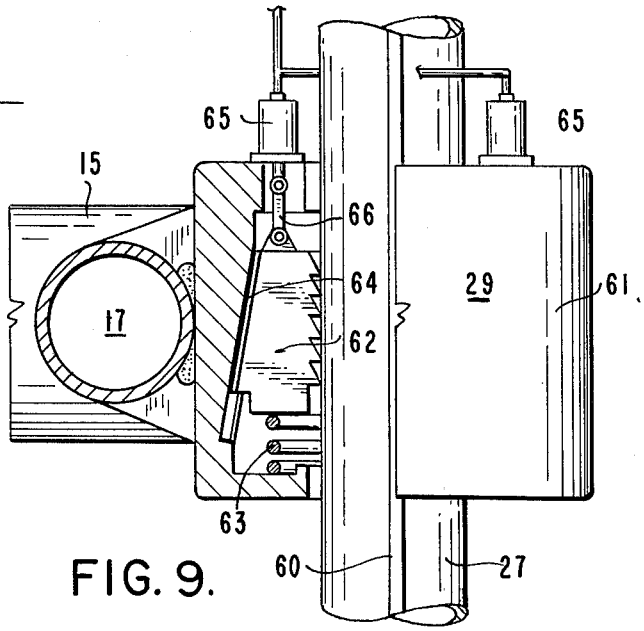

Referring to FIGS. 8 and 9 the support mechanism illustrated includes a key 60 formed on support column 27 which engages a keyway, not shown, within a clamp housing 61. The housing is welded to legs 15 and cross members 17. Within housing 61 are clamps or slips 62 shown in FIG. 9 engaged with support column 27 and biased upwardly by a spring 63 to wedge slips 62 against the wedged surface 64 to affix slips 62, aided by the weight of section 10, to support column 27. A plurality of spaced apart cylinders 65 contain pistons, not shown, which are linked as at 66 to movable slips 62. Power supplied to cylinders 65 biases the slips downwardly to disconnect them from support columns 22.

Figure 10:
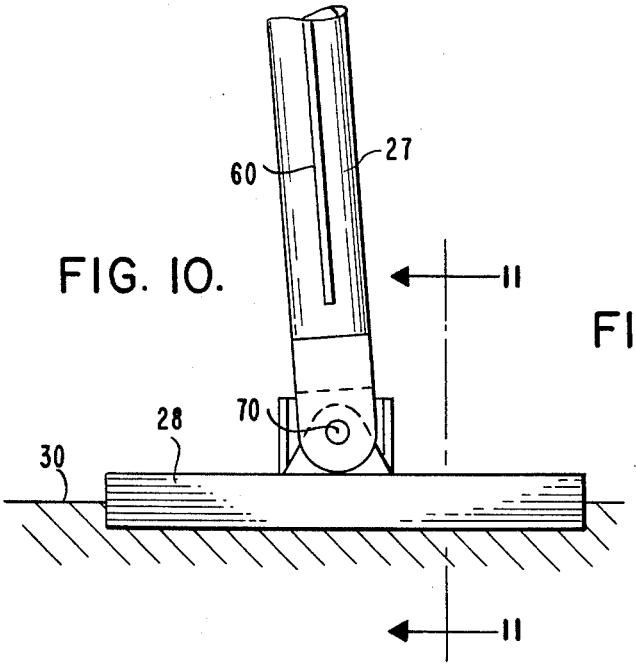
Figure 11:
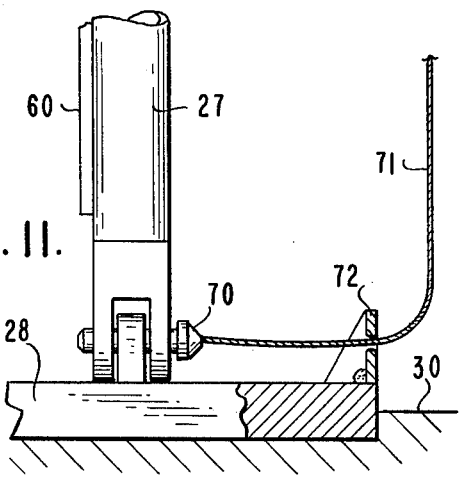

As shown in FIGS. 10 and 11 the lower end of support column 27 is pinned by a pin 70 to base member 28. Pin 70 is connected to a cable 71 which is threaded through an opening in a partition 72 formed on base member 28. Cable 71, operated from barge 56, is designed to pull pin 70 from its position connecting support column 27 and base member 28 to release support columns 27 from base member 28. Support column 27 is then removed. After removing support columns 27 base members 28 may be recovered by lines 71. Pins 70 engage partitions 72 as lines 71 are retrieved.

Referring now to FIGS. 12 through 14, an alignment and latching guide means, generally designated 90, are mounted on each of the legs to be connected together in making up the sections. A guide member prong 91 shown connected by suitable support brackets 92 to surface leg 15 of section 10 is conically shaped and provided with spring biased latches 93. A guide member sleeve 94 shown connected by suitable support brackets 95 to surface leg 45 of section 10 is also formed in a conical shape for receiving guide prong 91 and is provided with latch openings 96 for engagement with latches 93. Similarly, a conically shaped guide member prong 97 provided with latches 98 is connected to each of the submerged legs 16 of section 10 by bracket 99 and a conically shaped guide sleeve 100 provided with suitable latch slots 101 is connected to each submerged leg 46 of section 40 by brackets 102. Guide prong 91 and guide sleeve 94 are longer than guide prongs 97 and guide sleeve 100. The difference in the sizes of the guide prongs on the surface legs and the guide prongs on the submerged legs is to ensure that the submerged legs are properly aligned before engagement of guide prongs 97 and guide sleeves 100. Once guide prong 91 has entered guide sleeve 94 the surface legs are properly aligned and the lower submerged legs are also aligned properly with final precise alignment being achieved by guide prongs 97 and guide sleeves 100.

Referring again to FIGS. 5 through 7 sea cocks 24 and 50 and vent valves 25 and 51 are operated by a motor means 110 which by fluid power lines 112 are each connected to a common junction box or manifold 115 which is shown attached to the upper end of one of the legs of the section 40 in FIG. 17. Air injection lines 26, connected to each of the compartments, are connected to a manifold or junction box 114 also shown attached to one of the legs of section 40. Junction boxes 114 and 115 may also be attached to one of the legs of section 10 for controlling the buoyancy of that section. The valves are controlled from barge 56 by control means 116 connected to boxes 114 and 115 by way of hose bundle 118. The sea cock at one end of each compartment is a flooding valve and the vent valve at the other end provides air escape means. The legs of each section are provided with spaced apart centralizer means such as pile guides 120. Each section may have a door in each leg adjacent the flanges through which a welder may enter to weld the flanges together from the interior of the legs. Leg 15 has access tube 130 while leg 46 has an access tube 132 which connects to an access opening 134. As shown in FIG. 6, once the sections are joined, legs 15 and 45 define a compartment 130*a* closed by bulkheads 21 and 48. Likewise, legs 16 and 46 form a compartment 132*a* closed by bulkheads 21 and 48. Each of the compartments 130*a* and 132*a* is also provided with a sea cock, an air vent and an air injection connection.

Figure 19:
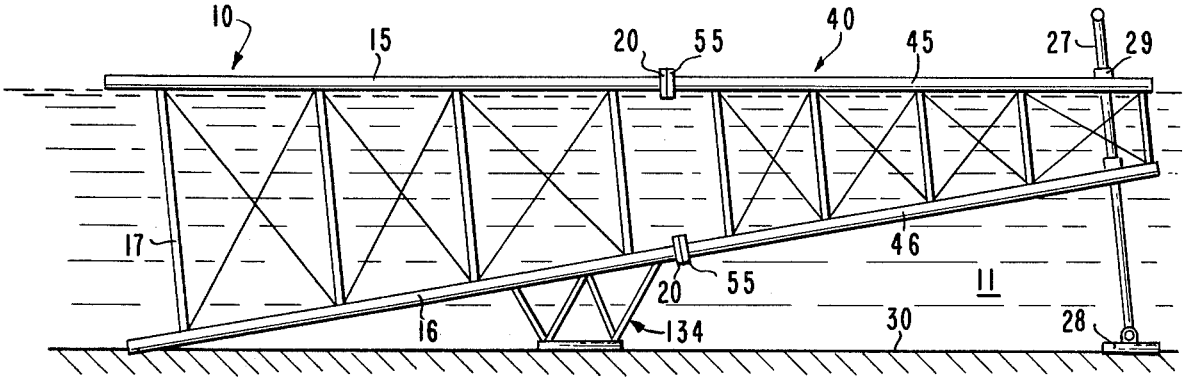
FIGS. 19, 20 and 21 illustrate modified support means which may be used in the method of the invention.

Another support structure is shown in FIG. 19 in which instead of the support column mechanism illustrated in FIGS. 1 to 4, a skid structure 13 is used to support the section or sections on the sea floor. As shown, the support mechanism (support column 27, base member 28 and clamp 29) may be used to support section 40 and skid 134 may be used to support section 10. Skid 134 would preferably be attached to section 10 prior to launching and be removed after the jacket has been erected or installed.

Figure 20:
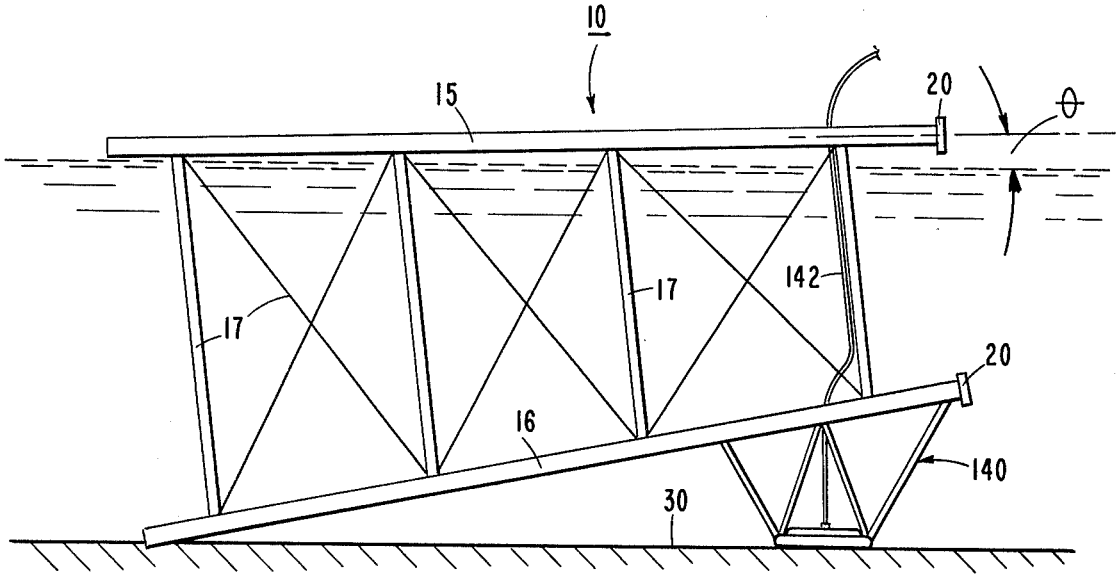
Figure 21:
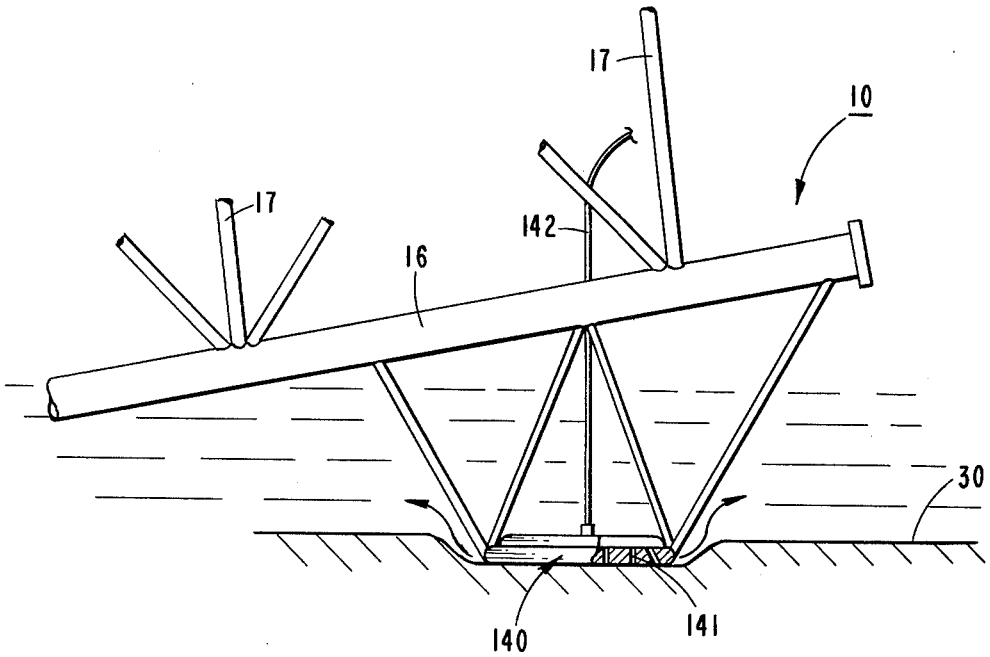

A modified skid arrangement is illustrated in FIGS. 20 and 21. A skid 140 contains openings 141 in its bottom portion which are connected to a conduit 142 for supplying water from the surface to jet-in skid 140 where it is necessary to adjust the position of the legs. As indicated, the initial position of section 10 is as in FIG. 20 and the angle theta is the angular distance leg 15 would move downwardly through the washing out process as indicated in FIG. 21.

When grounding the legs for the purpose of connecting them together on a natural grade the direction of the sections would be toward shore from the broadest or widest end to the narrowest end to take advantage of the natural slope of the sea floor. When using the supports to aid in grounding the sections it does not matter which direction the sections face.

Other changes and modifications may be made in the illustrative embodiments of the invention shown and/or described herein without departing from the scope of the invention as defined in the appended claims.

I claim:

1. A method for connecting two sections of an offshore jacket of an offshore platform, each section having at least three legs, each leg of one of said sections having a companion leg on the other of said sections comprising:

floating one of said sections in water with sufficient positive buoyancy to maintain said one section with at least one leg at or above the water's surface and the remaining leg or legs submerged to a selected shore site;

grounding said submerged leg or legs of said one section and making said one section negatively buoyant at said selected shore site;

floating said other section in said water with sufficient positive buoyancy to maintain said other section with at least one leg at or above the water's surface and the remaining leg or legs submerged to said selected shore site; and joining the companion legs of said sections to unitize said jacket.

2. A method as recited in claim 1 including the step of:

grounding said other section and making said other section negatively buoyant.

3. A method as recited in claim 2 in which each section is wider at one end than at the other end thereof and the legs of said sections slant inwardly from said one end to said other end thereof and including:

said sections being in the horizontal position with the legs of said sections extending substantially parallel to the water's surface while floating to said selected shore site and while being joined.

4. A method as recited in claim 3 in which said leg or legs adjacent the surface of the water when said sections are floating are raised above the surface of the water prior to joining the legs of said sections.

5. A method as recited in claim 4 including floating said unitized jacket to an installation site;

controllably flooding said jacket legs to cause said jacket to assume an upright position resting on the sea floor;

anchoring said jacket to said sea floor; and installing a working deck on the upper surface ends of said jacket legs.

6. A method as recited in claim 5 including support means on said jacket sections for supporting said sections on the sea floor by means of supporting mechanisms when said sections are grounded.

7. A method as recited in claim 6 including adjusting the boyancy of at least one of said sections when grounding and/or joining said sections.

8. A method as recited in claim 1 in which said leg or legs of said one section are grounded and then said one section is made negatively buoyant.

9. A method as recited in claim 1 in which the grounding of said leg or legs of said one section and making said one section negatively buoyant occur together.

10. Offshore platform apparatus comprising:

a first substructure jacket section for supporting an offshore platform having at least three hollow legs containing watertight and airtight compartments for flooding and dewatering said legs to adjust the buoyancy thereof, said first section when floated in the water having sufficient positive buoyancy to maintain said first section in the horizontal position with at least one leg at or above the water's surface and the remaining leg or legs submerged;

a second substructure jacket section for supporting an offshore platform; and support means on said submerged legs for supporting said first jacket section on the sea floor when said first jacket section is grounded for the purpose of joining said first jacket section to said second jacket section, said support means being located adjacent the end of said first jacket section which is to be joined to said second jacket section and said support means extending across said end of said first jacket section.

11. Apparatus as recited in claim 10 in which said support means are adjustable.

12. Apparatus as recited in claim 11 in which said support means includes:

support column means releasably connected to said first section;

a base member releasably attached to said support column means; and means for releasing said support column means from said base member.

13. Apparatus as recited in claim 11 in which said support means includes skid means connected to said submerged legs of said section.

14. Apparatus as recited in claim 13 in which said skid means includes means for jetting said skid means into the sea bottom to adjust the position of said legs of said first section.

15. Apparatus as recited in claim 10 in which said second jacket section contains at least three hollow legs having watertight and airtight compartments for flooding and dewatering said legs to adjust the buoyancy thereof, said second section when floated in the water having sufficient positive buoyancy to maintain said second section in the horizontal position with at least one leg at or above the water's surface and the remaining leg or legs submerged, and including:

means on said submerged legs of said second section for supporting said second section on the sea floor when said second section is grounded for the purpose of joining said first and second sections.

16. Apparatus as recited in claim 15 in which said support means on said second section are adjustable.

17. A method as recited in claim 1 in which each section has at least four legs and when said sections are floated in the water each section has sufficient positive buoyancy to maintain two legs at or above the water's surface.

18. Apparatus as recited in claim 8 in which said first jacket section has at least four hollow legs and when floated in the water said first section has sufficient positive buoyancy to maintain said first section in the horizontal position with two legs at or above the water's surface.

* * * * *